United States Patent [19]

Strubhar

[11] Patent Number: 4,867,241

[45] Date of Patent: Sep. 19, 1989

[54] LIMITED ENTRY, MULTIPLE FRACTURING FROM DEVIATED WELLBORES

[75] Inventor: Malcolm K. Strubhar, Irving, Tex.

[73] Assignee: Mobil Oil Corporation, New York, N.Y.

[21] Appl. No.: 201,650

[22] Filed: Jun. 1, 1988

Related U.S. Application Data

[63] Continuation-in-part of Ser. No. 929,462, Nov. 12, 1986, abandoned.

[51] Int. Cl.[4] ..... E21B 43/26

[52] U.S. Cl. ..... 166/308; 166/250; 166/297

[58] Field of Search ..... 166/308, 271, 259, 250, 166/50, 307, 297

[56] References Cited

U.S. PATENT DOCUMENTS

| | | | |
|---|---|---|---|
| 3,285,335 | 11/1966 | Reistle, Jr. | 166/2 |
| 3,547,198 | 12/1970 | Slusser | 166/254 |
| 3,712,379 | 1/1973 | Hill | 166/308 X |
| 3,835,928 | 9/1974 | Strubhar et al. | 166/308 |
| 3,863,709 | 2/1975 | Fitch | 165/1 |
| 3,878,884 | 4/1975 | Raleigh | 166/308 X |
| 3,896,879 | 7/1975 | Sareen et al. | 166/308 |
| 4,015,663 | 4/1977 | Strubhar | 166/258 |
| 4,019,577 | 4/1977 | Fitch et al. | 166/259 |
| 4,200,152 | 4/1980 | Foster et al. | 166/50 |
| 4,249,609 | 2/1981 | Haafkens et al. | 166/280 |
| 4,415,035 | 11/1983 | Medlin | 166/308 |

OTHER PUBLICATIONS

Cramer, "Limited Entry Extended to Massive Hydraulic Fracturing", Oil and Gas Journal, Dec. 1987.

Medlin, "Abnormal Treating Pressures in MHF Treatments", SPE publication, Oct. 1983.

Howard and Fast, "Hydraulic Fracturing", vol. 2, 1970, pp. 95–100.

*Primary Examiner*—Bruce M. Kisliuk

*Attorney, Agent, or Firm*—Alexander J. McKillop; Charles J. Speciale; Charles A. Malone

[57] ABSTRACT

A hydraulic fracturing process for inducing simultaneously, multiple vertical fractures in a deviated wellbore located in a subterranean formation for the removal of resources therefrom, particularly hydrocarbonaceous fluids. Said process results in increased recovery of hydrocarbonaceous fluids when combined with steam-flooding, solvent or surfactant stimulation processes. The wellbore is selectively perforated with holes sufficiently apart that multiple vertical fractures are produced. This occurs when the fracturing fluid rate through the limited holes causes a pressure drop across said holes sufficient to divert said fluid through essentially all of said holes.

18 Claims, 1 Drawing Sheet

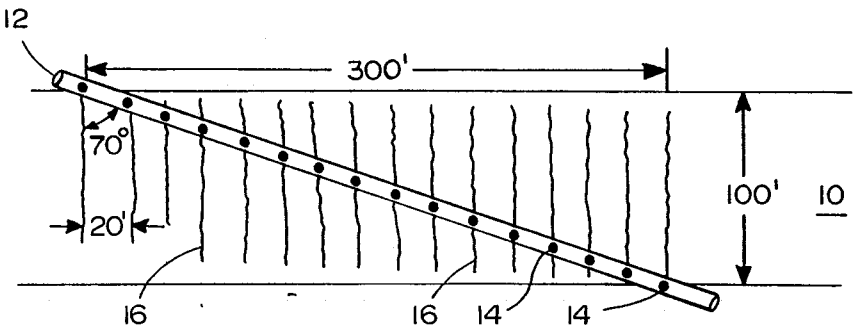
10
100'
300'
12
70°
20'
14
14
16
16

LIMITED ENTRY, MULTIPLE FRACTURING FROM DEVIATED WELLBORES

RELATED APPLICATIONS

This application is a continuation-in-part of copending application Ser. No. 929,462, filed Nov. 12, 1986, and incorporated herein by reference, now abandoned.

FIELD OF THE INVENTION

This invention is directed to the recovery of hydrocarbonaceous fluids from a low permeability formation via a deviated wellbore having multiple vertical fractures therein. Desired fracture locations are selected along the wellbore. Said wellbore is alternately perforated at the selected locations. Subsequently, the perforations are hydraulically fractured in a manner to form simultaneously, multiple fractures.

BACKGROUND OF THE INVENTION

Low permeability formations generally require significant stimulation to develop well productivity large enough to be of commercial value. Hydraulic fracturing, using proppant laden slurries and/or acid, is most commonly used in these stimulation applications. While individual well productivity usually is enough to generate profitable results, effective recovery of a significant percentage of the hydrocarbon in place is not assured. For example, in the Annona Chalk formation of the Caddo Pine Island Field in northwestern Louisiana, hydraulic fracturing has been utilized as a part of the initial completion procedure in most wells. While this results in acceptable profitability for most wells, the projected cumulative recovery for the field is only about 15% of the original-oil-in-place (OOIP).

One method for increasing the percentage recovery is to reduce spacing between wells which, when considering that each well is fractured, is tantamount to reducing the distance between fractures. Another method for decreasing the distance between fractures is described in Strubhar et al. U.S. Pat. No. 3,835,928 issued. Disclosed therein is a method for drilling a deviated wellbore in a direction substantially normal to the preferred induced fracture orientation and then creating multiple vertical fractures from the deviated wellbore. This was accomplished by selecting individual locations along the wellbore and alternately perforating and treating each set of perforations individually. The normal practice in deviated wellbores is to perforate with a high shot density to create a single, vertical fracture.

Medlin et al. in U.S. Pat. No. 4,415,035 disclose a method for forming fractures in a plurality of vertically disposed hydrocarbon-bearing formations communicating with a well equipped with a casing penetrating a subterranean earth formation. It is applicable to those hydrocarbon-bearing formations penetrated by said cased well that have exhibited at least a predetermined minimum pressure increase during previous individual fracturing treatments in other nearby production wells in the areas identified. Perforations are formed in the well casing at the locations of such identified hydrocarbon-bearing formations. Hydraulic pressure is then applied through the perforations to the plurality of hydrocarbon-bearing formations simultaneously, whereby each formation is fractured in proportion to the pressure increase in such formation during the application of hydraulic pressure.

Although pressure was applied through the perforations to the plurality of hydrocarbon-bearing formations simultaneously, fracturing occured in each formation sequentially. Also, in order for the method to work, each formation must have exhibited at least a predetermined minimum pressure increase.

Therefore, what is needed is a method to create simultaneously, multiple vertical fractures in a deviated wellbore located in a subterranean formation or reservoir where the formation is not required to exhibit a predetermined minimum pressure increase.

SUMMARY OF THE INVENTION

This invention is directed to a method for inducing simultaneous multiple vertical fractures in a deviated wellbore which penetrates a subterranean formation, which formation is not required to exhibit a predetermined minimum pressure increase. The distance said deviated wellbore must travel to obtain the most effective and efficient recovery of a desired material is first determined. Thereafter, a deviated wellbore is drilled the predetermined distance to obtain the most effective and efficient recovery of said desired material. Afterwards, a casing is placed into said deviated wellbore. Next, the number and size of perforations to be made in said casing is ascertained for forming fractures at desired locations. After deciding the fracture treatment fluid to be used, said fluid's pumping rate, and the perforation pressure drop necessary to divert said fluid through all the holes, pumping conditions are applied to said treating fluid at a pressure and rate sufficient to create simultaneously multiple vertical fractures in said formation through said holes.

It is therefore an object of this invention to utilize limited entry fracture treatment procedures in a deviated wellbore to achieve close fracture spacing without drilling individual wells or requiring a formation to exhibit a predetermined minimum pressure increase.

It is a further object of this invention to use a deviated wellbore containing multiple vertical fractures therein to effectively drain a reservoir, even those having very low permeability.

It is yet further object of this invention to create simultaneously, multiple vertical fractures which will intersect at least one natural fracture in a reservoir on which the productivity of a well is highly dependent.

It is a still yet further object of this invention to intersect more natural fractures than possible with a vertical well by using simultaneously induced multiple vertical fractures in a deviated well, particularly a well located in a hydrocarbonaceous fluid-bearing formation.

It is an even yet further object of this invention to use a deviated wellbore having simultaneously induced, multiple vertical fractures therein for the recovery of hydrocarbonaceous fluids in secondary and tertiary recovery methods as well as the recovery of other resources.

BRIEF DESCRIPTION OF THE DRAWINGS

The drawing is a schematic view of a deviated wellbore having simultaneously induced, multiple vertical fractures emanating from perforations therefrom where said wellbore is located in a formation from which it is desired to remove resources therefrom.

DESCRIPTION OF THE PREFERRED EMBODIMENTS

This invention is directed to a method for creating simultaneously, two or more multiple vertical fractures from a deviated wellbore. It is often necessary to create multiple vertical fractures in a formation to recover desired resources therefrom. This is necessary because often the formation is not as permeable as is desired. This invention, as disclosed below, can be utilized in many applications.

One such application is for facilitating the removal of ores from a formation containing same. Sareen et al. in U.S. Pat. No. 3,896,879, disclose a method for increasing the permeability of a subterranean formation penetrated by at least one well which extends from the surface of the earth into the formation. This method comprises the injection of an aqueous hydrogen peroxide solution containing therein a stabilizing agent through said well into the subterranean formation. After injection, the solution diffuses into the fractures of the formation surrounding the well. The stabilizing agent reacts with metal values in the formation which allows the hydrogen peroxide to decompose. The composition of hydrogen peroxide generates a gaseous medium causing additional fracturing of the formation. Sareen et al. were utilizing a method for increasing the fracture size to obtain increased removal of copper ores from a formation. This patent is hereby incorporated by reference. Utilization of the present invention will increase permeability by creating additional fractures.

In addition to removing ores, particularly copper ores and iron ores from a formation, the present invention can be used to recover geothermal energy more efficiently by the creation of more fractures. A method for recovering geothermal energy is disclosed in U.S. Pat. No. 3,863,709 which issued to Fitch on Feb. 4, 1975. This patent is hereby incorporated by reference. Disclosed in this patent is a method and system for recovering geothermal energy from a subterranean geothermal formation having a preferred vertical fracture orientation. At least two deviated wells are provided which extend into the geothermal formation in a direction transversely of the preferred vertical fracture orientation. A plurality of vertical fractures are hydraulically formed to intersect the deviated wells. A fluid is thereafter injected via one well into the fractures to absorb heat from the geothermal formation and the heated fluid is recovered from the formation via another well.

The present invention can also be used to remove thermal energy produced during in situ combustion of coal by the creation of additional fractures. A method wherein thermal energy so produced by in situ combustion of coal is disclosed in U.S. Pat. No. 4,019,577 which issued to Fitch et al. on Apr. 26, 1977. This patent is hereby incorporated by reference. Disclosed therein is a method for recovering thermal energy from a coal formation which has a preferred vertical fracture orientation. An injection well and a production well are provided to extend into the coal formation and a vertical fracture is formed by hydraulic fracturing techniques. These fractures are propagated into the coal formation to communicate with both the wells. The vertical fracture is propped in the lower portion only. Thereafter, a combustion-supporting gas is injected into the propped portion of the fracture and the coal is ignited. Injection of the combustion-supporting gas is continued to propagate a combustion zone along the propped portion of the fracture and hot production gases generated at the combustion zone are produced to recover the heat or thermal energy of the coal. Water may also be injected into the fracture to transport the heat resulting from the combustion of the coal to the production well for recovery therefrom. Both the injection and production wells can be deviated wells which penetrate said coal formation in a direction transversely of the preferred fracture orientation.

Recovery of thermal energy from subterranean formations can also be used to generate steam. A method for such recovery is disclosed in U.S. Pat. No. 4,015,663 which issued to Strubhar on Apr. 5, 1977. This patent is hereby incorporated by reference.

In the practice of this invention, as shown in the drawing, a deviated wellbore 12 is placed into the pay zone of formation 10. Said wellbore 12 goes through formation 10 from which formation it is desired to remove a subterranean resource such as iron, copper ore, uranium ore, geothermal heat, coal, oil shale or hydrocarbonaceous fluids. A deviated well is drilled through formation 10 in a direction and angle which allows traverse of the hydrocarbonaceous formation to the preferred fracture orientation which is perpendicular to the least principal in-situ horizontal stress into which it is desired to induce simultaneously, more than two multiple vertical fractures.

Methods for determining the preferred fracture orientation are described by Slusser in U.S. Pat. No. 3,547,198. This patent is hereby incorporated by reference. As taught therein, the preferred fracture orientation exists because of naturally occurring planes or weakness in the earth's formations. It is known that the subterranean formations adjoin in a manner similar to surface rock. Therefore, surface measurements may be employed as a reasonably close indication of the preferred fracture orientation. The preferred fracture orientation may also be determined from measurements taken in wells penetrating a subterranean earth formation of interest. For example, impression packer surveys may be run throughout the area to determine the fracture orientation. Borehole Televiewer surveys offer a particularly good method of determining the preferred fracture trends. Borehole Televiewer surveys are discussed in an article by J. Zemanek et al., entitled "The Borehole Televiewer—A New Logging Concept for Fracture Location and Other Types of Borehole and Inspection," Journal of Petroleum Technology, Vol. XXI (June, 1969), pp. 762–774. Other methods for determining the preferred orientation are described in U.S. Pat. No. 3,285,335. This patent is hereby incorporated by reference.

When the position of the fracture plane is determined, the direction of the slanted hole may be described either in terms of the angle it makes with the direction of maximum principal stress or in terms of the angle of incidence which the borehole makes with the fracture plane, the angle of incidence being the angle between the line of the slanted borehole and the line parallel to the fracture plane at the point of intersection of the borehole and the plane. This angle can be any angle that allows traverse of the hydrocarbonaceous formation with a directional component normal to the preferred fracture orientation. To minimize the amount of hole drilled to permit the creation of several vertical fractures, this angle is from about 10° to about 90°, preferably about 30° or larger.

Another angle to consider is the angle of deviation from vertical of the wellbore as it passes through the formation of interest. This angle is critical to the amount of borehole exposed to the formation of interest from which multiple fractures can be simultaneously created. This angle should be about 10° to about 90°. In the drawing, the angle of deviation is depicted as about 70° from vertical as one example.

Wellbore 12 will have a casing therein. Wellbore 12 is deviated at least in the lower portion thereof such that it penetrates the subterranean formation 10 at an angle of at least about 10° measured from the vertical and in an azimuth direction transversely to the preferred fracture orientation. If a casing is utilized, it is cemented into wellbore 12. Thereafter, the casing is selectively perforated in a manner so that in subsequent fracture treatments, fluids being pumped therein will pass through all perforations at a substantial rate. Thus, limited perforations will be required and matched to the pump rate to achieve a pressure drop across the perforations resulting in diversion of fluid through all holes. The pumping rate should be at least about one to about 10 barrels per fracture where each fracture emanates from one or more holes so as to result in a pressure drop of about 200 psi or more across said hole(s). Borehole 12 is perforated to provide a plurality of perforations at preselected intervals therein. These perforations are spaced about 10 to about 100 feet apart so the desired fracture spacing can be obtained. Such perforations may at each level comprise two sets of perforations which are simultaneously formed on opposite sides of the borehole 12. A set can be one or more perforations. Preferably, these perforations should have diameters between about ¼ and about ½ of an inch and should be placed circumferentially about the casing in the anticipated plane of the induced fracture. Other perforating techniques that will achieve limited entry conditions while permitting simultaneous creation of multiple, vertical fractures may be employed and will be apparent to those skilled in the art.

"Limited entry" as defined herein is the practice of limiting the number of perforations in a completion interval to promote the development of perforation friction pressure during a stimulation treatment.

Perforations will be placed in borehole 12 in a manner such as to obtain the predetermined proper distance between fractures based upon reservoir characteristics. This determination is made in order to balance the effective reservoir drainage with the highest degree of profitability.

To create the desired simultaneous, multiple vertical fractures, wellbore 12 is perforated such that the horizontal distance between individual or clusters of perforations is equivalent to the preferred distance between fractures. The number and size of perforations are determined by the fracture treatment pumping rate and the pressure drop necessary to divert fluid through all holes.

Referring to the drawing, the distance between vertical fractures is determined to be about 20 feet. The formation thickness is about 100 feet. The horizontal distance the deviated wellbore 12 will travel is determined to be about 300 feet. A wellbore is drilled into the pay zone of formation 10 which is approximately 70° from vertical, permitting approximately 16 fractures to be induced from the wellbore intersecting formation 10. Assuming that a pumping rate of five barrels per minute (BPM) per fracture is a minimum rate suitable to achieve adequate fracture growth, the total pump rate for the 16 fractures would be about 80 BPM. By utilizing 0.5 inch perforations, two perforations per fracture (a total of 32 holes) would result in a 260 psi pressure drop across perforations according to FIG. 7–10, page 104, SPE Monograph 1 by G. C. Howard and C. R. Fast. This pressure drop is sufficient to successfully divert fracturing fluid through all perforations. Upon application of the determined pressure at the determined rate through said perforations, simultaneous, multiple vertical fractures are produced in formation 10. Use of this method allows the creation of more than two simultaneous, multiple vertical fractures in one or more productive intervals of a formation. The resultant fractures are created and do not require the productive interval of the formation to exhibit at least a minimum pressure increase during the fracturing operation as required by Medlin et al. in U.S. Pat. No. 4,415,035 which issued on Nov. 15, 1983. This patent is incorporated herein in its entirety. Practicing the method disclosed herein enables one to produce more than two simultaneous, multiple vertical fractures via a deviated wellbore which penetrates one or more productive intervals in a formation.

Fracturing fluids which can be utilized include simple Newtonian fluids, gels described as Power Law fluids, and acids. Use of acids for a fracturing fluid is discussed in U.S. Pat. No. 4,249,609 issued to Haafkens et al. on Feb. 10, 1981. This patent is hereby incorporated by reference. Use of a gel as a fracturing fluid is disclosed in U.S. Pat. No. 4,415,035 issued to Medlin et al. on Nov. 15, 1983. This patent is hereby incorporated by reference.

In a preferred mode of operation, perforations 14 as shown in the drawing can be treated, or "broken down" prior to pumping the main fracture treatment. A suitable "breakdown" treatment can consist of pumping an acid such as hydrochloric acid of a concentration of about 7.5 vol. % at about 20 BPM. Ball sealers can be included in the acid to plug off perforations 14 receiving said acid. This would allow other perforations to be opened.

Following the breakdown treatment, the main fracturing treatment would be pumped into wellbore 12 starting with a pre-pad or pad volume prior to pumping a fluid laden with proppant. Acid, such as hydrochloric acid, could be used in place of a proppant laden fracturing fluid to achieve fracture conductivity by formation etching in a carbonate reservoir. It can also be used as a means for substantially opening up perforations to accept fracturing fluids. Said acid can also be used as a carrier for the proppant should a proppant be desired. Treatment volumes for utilization can be selected on the basis of the design specification to achieve the specific fracture dimensions desired.

Use of this limited entry fracture treatment in a deviated wellbore can achieve close fracture spacing without drilling individual wells. It can also result in effective reservoir drainage even in very low permeability reservoirs.

Another application of this technology can be utilized in reservoirs that contain natural fractures upon which well productivity is highly dependent. This would result because the deviated wellbore itself can likely intersect more natural fractures than a vertical well. Equally important, multiple induced vertical fractures would greatly increase the number of intersections with the natural fracture network. Spacing of the induced fractures can be selected on the basis of apparent distribution of the natural fractures.

Vertical simultaneous fractures induced in the deviated wellbore of the present invention would permit secondary and tertiary recovery techniques to be used effectively in low permeability reservoirs where use of current technology is impractical. Utilization of the present invention in combination with the injection of secondary and tertiary recovery fluids would result in the production of reservoir fluids from alternate pairs of fractures in an effective manner within practical time limits.

Although the present invention has been described with preferred embodiments, it is to be understood that modifications and variations may be resorted to without departing from the spirit and scope of this invention, as those skilled in the art would readily understand.

What is claimed is:

1. A limited entry method for inducing simultaneously multiple vertical fractures in a deviated wellbore penetrating a subterranean formation comprising:
   (a) determining a horizontal distance said deviated wellbore must travel to obtain the most effective and efficient recovery of resources from said formation which formation is not required to exhibit a predetermined minimum pressure increase;
   (b) drilling the deviated wellbore through said formation at an angle of deviation sufficient to achieve the horizontal distance and at an angle of incidence to a preferred fracture orientation sufficient to obtain the most effective and efficient recovery of said resources;
   (c) casing said deviated wellbore;
   (d) ascertaining the number and size of holes to be made in said wellbore casing after deciding a fracture treatment fluid to be used, said fluid's pumping rate, and the perforation pressure drop necessary to divert said fluid through all holes at a rate sufficient to simultaneously create multiple vertical fractures in said formation;
   (e) perforating said wellbore to create holes therein of said ascertained number and size sufficient to create said fractures when flowing a treating fluid therethrough at an ascertained pumping rate; and
   (f) placing a pressure on said treating fluid in an amount and at a pumping rate sufficient to create simultaneously multiple vertical fractures in said formation through said holes.

2. The method as recited in claim 1 where in step (b) the angle of incidence is from about 10° to about 90°.

3. The method as recited in claim 1 where in step (b) said angle of deviation is from about 10° to about 90°.

4. The method as recited in claim 1 where in step (e) said fractures are about 10 to about 100 feet apart and are derived from holes of a diameter of about 0.25 to about 0.5 inches along said wellbore.

5. The method as recited in claim 1 where in step (e) the pumping rate is at least about one to about 10 barrels per minute per fracture and where each fracture emanates from one or more holes which results in a pressure drop of about 200 psi or more across said holes.

6. The method as recited in claim 1 where in step (d) said holes are treated prior to placing a main fracturing treatment fluid into said deviated wellbore and which treatment comprises a solution of about 7.5 volume % hydrochloric acid that is pumped into the wellbore at a rate of about 20 barrels per minutes.

7. The method as recited in claim 1 where after step (e) and prior to creating said multiple fractures, hydrochloric acid is placed through the holes as a means for substantially opening up perforations to accept fracturing fluids.

8. The method as recited in claim 1 where after step (e) ball sealers are placed in a solution of about 7.5 volume percent hydrochloric acid to close off those perforations which have previously received acid to allow other perforations to be opened.

9. The method as recited in claim 1 where said formation contains a subterranean resource such as iron, copper ore, uranium ore, geothermal heat, coal, oil shale, or hydrocarbonaceous fluids.

10. A limited entry method for inducing simultaneously multiple vertical fractures in a subterranean formation via a deviated wellbore comprising:
   (a) determining a horizontal distance said deviated wellbore must travel to obtain the most effective and efficient recovery of resources from said formation which formation is not required to exhibit a predetermined minimum pressure increase;
   (b) drilling the deviated wellbore through said formation at an angle of deviation sufficient to achieve the horizontal distance and at an angle of incidence to a preferred fracture orientation sufficient to obtain the most effective and efficient recovery of said resources;
   (c) casing said deviated wellbore;
   (d) ascertaining the number and size of holes to be made in said wellbore casing after deciding a fracture treatment fluid to be used, said fluid's pumping rate, and the perforation pressure drop necessary to divert said fluid through all holes at a rate sufficient to simultaneously create more than two multiple vertical fractures in one productive interval of said formation;
   (e) perforating said wellbore to create holes therein of said ascertained number and size sufficient to create said fractures when flowing a treating fluid therethrough at an ascertained pumping rate; and
   (f) placing a pressure on said treating fluid in an amount and at a pumping rate sufficient to create simultaneously more than two vertical fractures in said formation through said holes.

11. The method as recited in claim 10 where in step (b) the angle of incidence is from about 10° to about 90°.

12. The method as recited in claim 10 where in step (b) said angle of deviation is from about 10° to about 90°.

13. The method as recited in claim 10 where in step (e) said fractures are about 10 to about 100 feet apart and are derived from holes of a diameter of about 0.25 to about 0.5 inches along said wellbore.

14. The method as recited in claim 10 where in step (e) the pumping rate is at least about one to about 10 barrels per minute per fracture and where each fracture emanates from one or more holes which results in a pressure drop of about 200 psi or more across said holes.

15. The method as recited in claim 10 where in step (d) said holes are treated prior to placing a main fracturing treatment fluid into said deviated wellbore and which treatment comprises a solution of about 7.5 volume % hydrochloric acid that is pumped into the wellbore at a rate of about 20 barrels per minutes.

16. The method as recited in claim 10 where after step (e) and prior to creating said multiple fractures, hydrochloric acid is placed through the holes as a means for substantially opening up perforations to accept fracturing fluids.

17. The method as recited in claim 10 where after step (e) ball sealers are placed in a solution of about 7.5 volume percent hydrochloric acid to close off those perforations which have previously received acid to allow other perforations to be opened.

18. The method as recited in claim 10 where said formation contains a subterranean resource such as iron, copper ore, uranium ore, geothermal heat, coal, oil shale, or hydrocarbonaceous fluids.

* * * * *